US007625073B2

(12) United States Patent
Kitakami et al.

(10) Patent No.: US 7,625,073 B2
(45) Date of Patent: Dec. 1, 2009

(54) LIQUID DISCHARGE HEAD AND RECORDING DEVICE

(75) Inventors: Koichi Kitakami, Kanagawa (JP); Tatsuo Furuta, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 480 days.

(21) Appl. No.: 11/441,026

(22) Filed: May 26, 2006

(65) Prior Publication Data

US 2007/0002092 A1 Jan. 4, 2007

(30) Foreign Application Priority Data

Jun. 16, 2005 (JP) ..... 2005-175897
Dec. 16, 2005 (JP) ..... 2005-362597

(51) Int. Cl.
*B41J 2/045* (2006.01)

(52) U.S. Cl. ..... 347/68

(58) Field of Classification Search ..... 347/68, 347/69–72; 29/25.35
See application file for complete search history.

(56) References Cited

U.S. PATENT DOCUMENTS

| | | | | |
|---|---|---|---|---|
| 5,530,465 | A | 6/1996 | Hasegawa et al. | |
| 6,336,717 | B1 | 1/2002 | Shimada et al. | |
| 6,341,850 | B1 * | 1/2002 | Sakai | 347/70 |
| 6,345,424 | B1 | 2/2002 | Hasegawa et al. | |
| 6,527,376 | B1 | 3/2003 | Itaya et al. | |
| 6,582,060 | B1 | 6/2003 | Kitakami et al. | |
| 6,764,167 | B2 | 7/2004 | Shimada et al. | |
| 6,869,170 | B2 | 3/2005 | Shimada et al. | |

FOREIGN PATENT DOCUMENTS

| | | |
|---|---|---|
| JP | 2952994 | 7/1999 |
| JP | 11-300971 | 11/1999 |
| JP | 2000-272126 | 10/2000 |
| JP | 2002-187271 | 7/2002 |
| JP | 3379538 | 12/2002 |

* cited by examiner

*Primary Examiner*—K. Feggins
(74) *Attorney, Agent, or Firm*—Fitzpatrick, Cella, Harper & Scinto

(57) ABSTRACT

A liquid discharge head includes a discharge port for discharging liquid; a liquid chamber communicating with the discharge port; a piezoelectric element including one electrode layer, another electrode layer, and a piezoelectric film sandwiched between the one electrode layer and the other electrode layer independently arranged in correspondence with the liquid chamber, and including a piezoelectric drive portion where the piezoelectric film deforms and displaces in correspondence with the liquid chamber; and a vibration plate interposed between the piezoelectric element and the liquid chamber. A bending rigidity of both ends in an arranging direction of the one electrode layer of a portion corresponding to the piezoelectric drive portion of the vibration plate is greater than the bending rigidity of a region between both ends.

1 Claim, 12 Drawing Sheets

LIQUID DISCHARGE HEAD AND RECORDING DEVICE

BACKGROUND OF THE INVENTION

1. Field of the Invention

The present invention relates to a liquid discharge head including a discharge port for discharging liquid droplets and a liquid chamber communicating to the discharge port, the liquid droplets being discharged by changing the volume of the liquid chamber; and a recording device. The liquid discharge head and the recording device of the present invention are applicable to a recording device for printing on paper, cloth, leather, non-woven cloth, OHP sheet and the like, a patterning device, an application device and the like for applying liquid to a solid object such as a substrate, plate material and the like.

2. Related Background Art

Conventionally, recording devices such as those of the ink jet type are widely used in recording apparatuses such as printers, facsimile machines and the like due to their low noise, low running cost, and easiness to miniaturize and colorize the device. In particular, the application of the liquid discharge head that uses piezoelectric actuator and the like as a patterning device dedicated for device manufacturing is becoming more widespread due to its high degree of freedom of selection of the discharging liquid.

As disclosed in Japanese Patent No. 3379538, the process of discharging the liquid from the discharge port in the liquid discharge head using the piezoelectric actuator will now be described in detail. The volume control for contracting or expanding the volume of the individual liquid chamber is performed by applying displacement that transitions with time to a vibration plate forming one part of an individual liquid chamber by providing an electrical signal. Thus, the liquid extends and starts to project out to the outer side in a liquid column state. Thereafter, the liquid flies over a gap or the recording gap (between liquid discharge head and material to be recorded) while being separated into a plurality of liquid droplets by surface tension.

On one hand, higher resolution in the line of the nozzle (liquid discharge port) and finer amount of discharged liquid amount are being forwarded in applications to the recording device or patterning device. Higher precision of liquid droplet displacement accuracy is also being achieved. A method of narrowing the width of the individual liquid chamber is being studied as a principal method for obtaining higher resolution.

However, when enhancing the resolution by narrowing the width of the individual liquid chamber, in particular, when narrowing the width of the individual liquid chamber in a vendor type liquid discharge head, bending deformation of the vibration plate and further the displacement of the vibration plate resulting therefrom cannot be sufficiently ensured. A desired discharging performance (discharge amount and discharge speed) thus cannot be realized.

Consideration is made in making the thickness of the vibration plate as thin as possible as a countermeasure for such problem. However, the following problems were found from the detailed studies by the inventors.

The object of the studies is the liquid discharge head referred to as a unimorph type (vendor type) piezo-recording head having a piezoelectric body and an electrode formed on the vibration plate. Various types with the thickness of the vibration plate changed were prepared in the piezo-recording head to compare the discharge lifetime. The criteria for determining the lifetime is the period during which liquid leakage is produced at the vibration plate portion due to breakage of the vibration plate. The number of discharging operations up to such point was evaluated. As can be easily assumed, the lifetime due to breakage of the vibration plate was shorter in thinner vibration plates.

In Japanese Patent Application Laid-open No. 2000-272126, an actuator device is disclosed in which the end of the lower electrode is the end of a piezoelectric body active part acting as a substantial drive portion of the piezoelectric element, and a film thickness part is arranged on the insulative layer on the outer side of the end of the lower electrode. As hereinafter described, the position where the portion corresponding to the "film thickness part" is arranged in the example of the present invention is clearly different from that in Japanese Patent Application Laid-open No. 2000-272126.

SUMMARY OF THE INVENTION

The present invention aims to provide a liquid discharge head with the width of the individual liquid chamber narrowed to realize high resolution, where the breakage of the vibration plate is prevented to extend the lifetime and ensure sufficient discharging lifetime; and a recording device.

In order to achieve the above aim, the liquid discharge head of the present invention comprises a discharge port for discharging liquid; a liquid chamber communicating with the discharge port; a piezoelectric element including one electrode layer, another electrode layer, and a piezoelectric film sandwiched between the one electrode layer and the other electrode layer independently arranged in correspondence with the liquid chamber, and including a piezoelectric drive portion where the piezoelectric film deforms and displaces in correspondence with the liquid chamber; and a vibration plate interposed between the piezoelectric element and the liquid chamber, wherein a bending rigidity of both ends in an arranging direction of the one electrode layer of a portion corresponding to the piezoelectric drive portion of the vibration plate is greater than the bending rigidity of a region between both ends.

According to the present invention, in a configuration in which the width of the liquid chamber is narrowed to achieve high resolution, the breakage of the vibration plate is prevented and the lifetime is extended by increasing the bending rigidity of a peripheral region of the vibration plate even if the vibration plate is thinned to sufficiently ensure displacement of the vibration plate. The liquid discharge head having high resolution and long lifetime is thereby provided.

BRIEF DESCRIPTION OF THE DRAWINGS

FIG. 1A is a partial cross-sectional view showing the main part of the recording head, FIG. 1B shows a plan schematic view of the recording head, and FIG. 1C is a view explaining a method for manufacturing a vibration plate;

FIG. 3A is of prior art and FIG. 3B is of the example;

DESCRIPTION OF THE PREFERRED EMBODIMENTS

The embodiments of the present invention will now be described based on the figures.

"Piezoelectric drive portion" of a piezoelectric element in the present invention refers to a portion of the piezoelectric element corresponding to the self deforming portion sandwiched between a pair of electrode layers of the piezoelectric film, the portion of the piezoelectric element being displaceable in correspondence to the liquid chamber. The present invention has a feature in that the bending rigidity of both ends in the arrangement direction of one of the electrode layers of the portion corresponding to the piezoelectric drive portion of the vibration plate is greater than the bending rigidity of the region between both ends. In the present invention, the piezoelectric drive portion and the vibration plate are entirely in contact with each other.

In a first exemplary embodiment according to the present invention, Young's modulus of the portion corresponding to both ends of the vibration plate is greater than the Young's modulus of the region between both ends. In this case, the difference in the Young's modulus is preferably greater than or equal to 40 GPa. This is because the effect of the present invention appears at a higher level.

In a second exemplary embodiment according to the present invention, the portion corresponding to both ends of the vibration plate is thicker than the region between both ends. In this case, the difference in thickness is preferably greater than or equal to 1 μm. This is because the effect of the present invention appears at a higher level. In the present embodiment, a form in which the thick portion of both ends of the vibration plate bulges to the inner side of the liquid chamber is more preferable than a form in which the relevant thick portion bulges to the outer side. This is because the head is more easy to be manufactured (e.g., easy to grow film on the outer side of the vibration plate) when the bulged portion is on the inner side of the liquid chamber.

In the present invention, the first exemplary embodiment is more preferable than the second exemplary embodiment. This is because the basic configuration of the first exemplary embodiment does not have the bulged portion at the vibration plate, thereby making the head easier to manufacture.

Figures 1A, 1B, 1C:
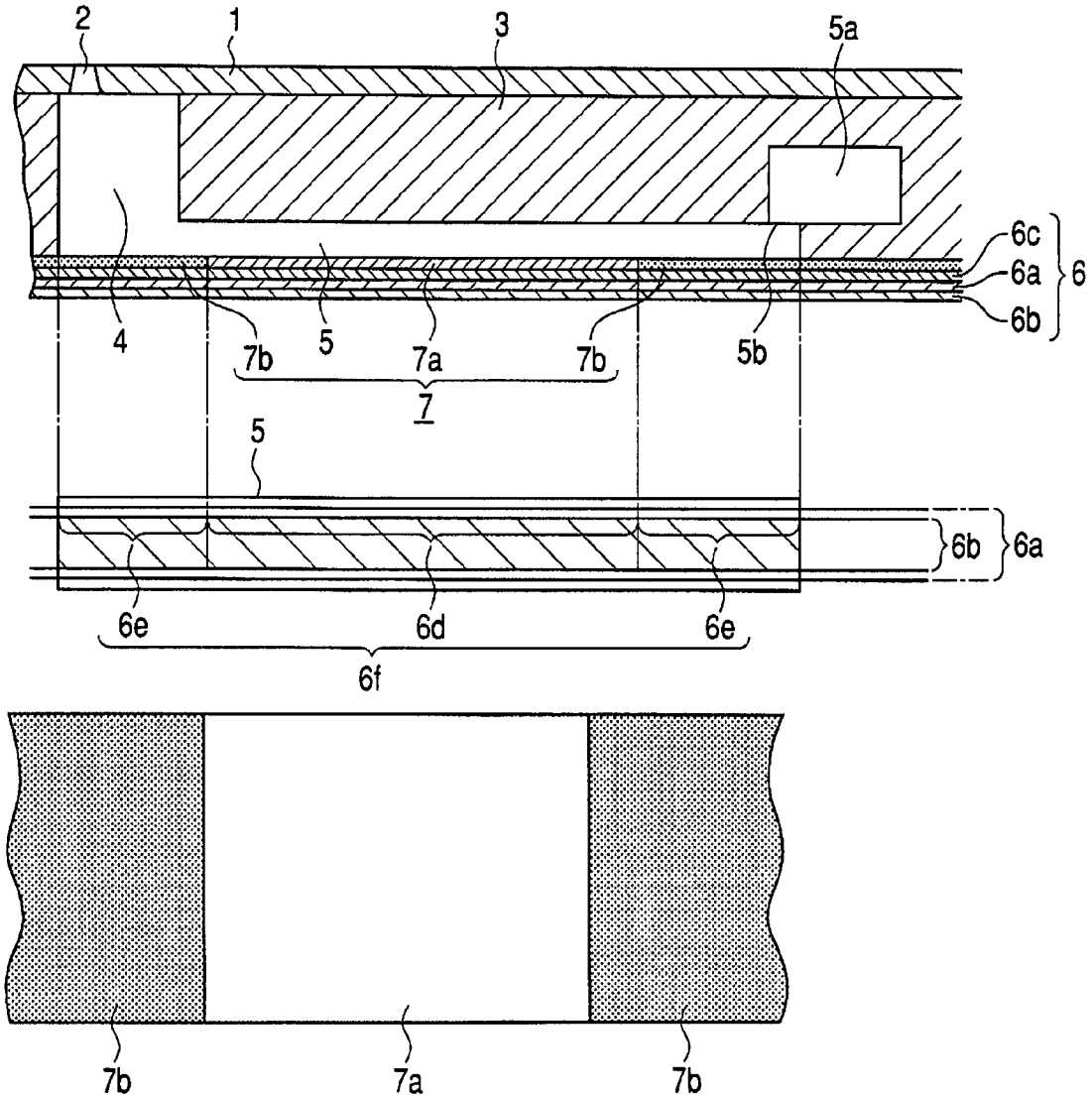
FIGS. 1A, 1B and 1C are views showing a recording head according to an example 1, where

In the present invention, the thickness of the vibration plate is preferably less than or equal to 10 μm. This is because the effect of the present invention appears at a higher level. As shown in FIGS. 1A and 1B, the recording head functioning as the liquid discharge head includes a nozzle 2 functioning as a discharge port formed in a nozzle plate 1, and a communication port 4 and an individual liquid chamber 5 functioning as a liquid chamber formed in a base body 3 according to the present invention. Further, a piezoelectric element 6 functioning as volume changing means is provided for pressurizing the ink or liquid in the individual liquid chamber 5 by controlling (changing) the volume of the individual liquid chamber 5. The pressurizing force by the piezoelectric element 6 is transmitted to the ink inside the individual liquid chamber 5 through the vibration plate 7.

A first region (central region) 7*a* corresponding to the central part of the individual liquid chamber 5 inside the vibration plate 7 is made of heat resistant glass and the like having a small Young's modulus so as to obtain sufficient displacement of the vibration plate. A second region (peripheral region) 7*b* of the vibration plate 7 corresponding to the peripheral part of the individual liquid chamber 5 is made of silicon and the like. That is, the peripheral region or the second region 7*b* of the vibration plate 7 is configured to have a higher Young's modulus than the central region or the first region 7*a* on the inside.

As miniaturization proceeds with smaller nozzle pitch of the liquid discharge head, the vibration plate must be thinned to obtain sufficient displacement of the vibration plate, which causes breakage at the vibration plate and shortens the lifetime of the liquid discharge head. Thus, the Young's modulus of the peripheral region of the vibration plate having a large displacement amount is increased to prevent the breakage of the vibration plate and to achieve longer lifetime of the liquid discharge head.

Example 1

FIGS. 1A, 1B, 1C and 2 illustrate example 1. A method of arranging the piezoelectric element 6 in correspondence with the nozzle 2, and discharging liquid droplets from the nozzle 2 by providing a drive signal corresponding to the recording information to the piezoelectric element 6 is adopted. The electrode wiring for supplying power to the piezoelectric element 6 is arranged. The piezoelectric element 6 includes an upper electrode (one electrode layer) 6*b*, a lower electrode (other electrode layer) 6*c*, and a piezoelectric film 6*a* sandwiched between a pair of electrodes. The vibration plate 7 and the lower electrode 6*c* are arranged on the entire surface of the substrate across the adjacent liquid chamber, and the piezoelectric film 6*a* and the upper electrode 6*b* are arranged corresponding individually to the liquid chamber 5 as shown in FIG. 1B (plan schematic view of FIG. 1A). The vibration plate 7 is arranged so as to be interposed between the piezoelectric element 6 and the liquid chamber 5.

The reference numeral 5*a* is a supply path for supplying liquid to the liquid chamber 5. The supply path 5*a* is arranged extending in the direction perpendicular to the surface of FIG. 1A. The liquid is supplied to each of a plurality of liquid chambers 5 by way of the supply path 5*b*.

In FIG. 1B, the reference numeral 5 denotes the outer periphery of the liquid chamber. The reference numeral 6*f* is a piezoelectric drive portion where the piezoelectric film 6*a* deforms and displaces. As described above, the piezoelectric drive portion 6*f* of the piezoelectric element 6 refers to a portion corresponding to the self deforming portion sandwiched between the pair of electrodes 6*b*, 6*c* of the piezoelectric element 6, the portion (portion corresponding to the hatched portion in FIG. 1B) being displaceable in correspondence with the liquid chamber 5. The bending rigidity of both ends (correspond to 6*e*) in the arranging direction (left and right direction in FIG. 1B) of the upper electrode 6*b* of the portion corresponding to the piezoelectric drive portion 6*f* of the vibration plate 7 is greater than the bending rigidity of the region (correspond to 6*d*) between both ends.

A method for manufacturing the recording head will now be explained. First, the base body 3 is manufactured in the following manner. An etching mask is formed on a silicon substrate using photolithography. An oxidized film and the like having a thickness of 1 μm is used for the etching mask. An ICP (Inductively Coupled Plasma) etching device is used for the etching device, and $SF_6$, $C_4F_8$ is used for the etching gas.

Figure 2:
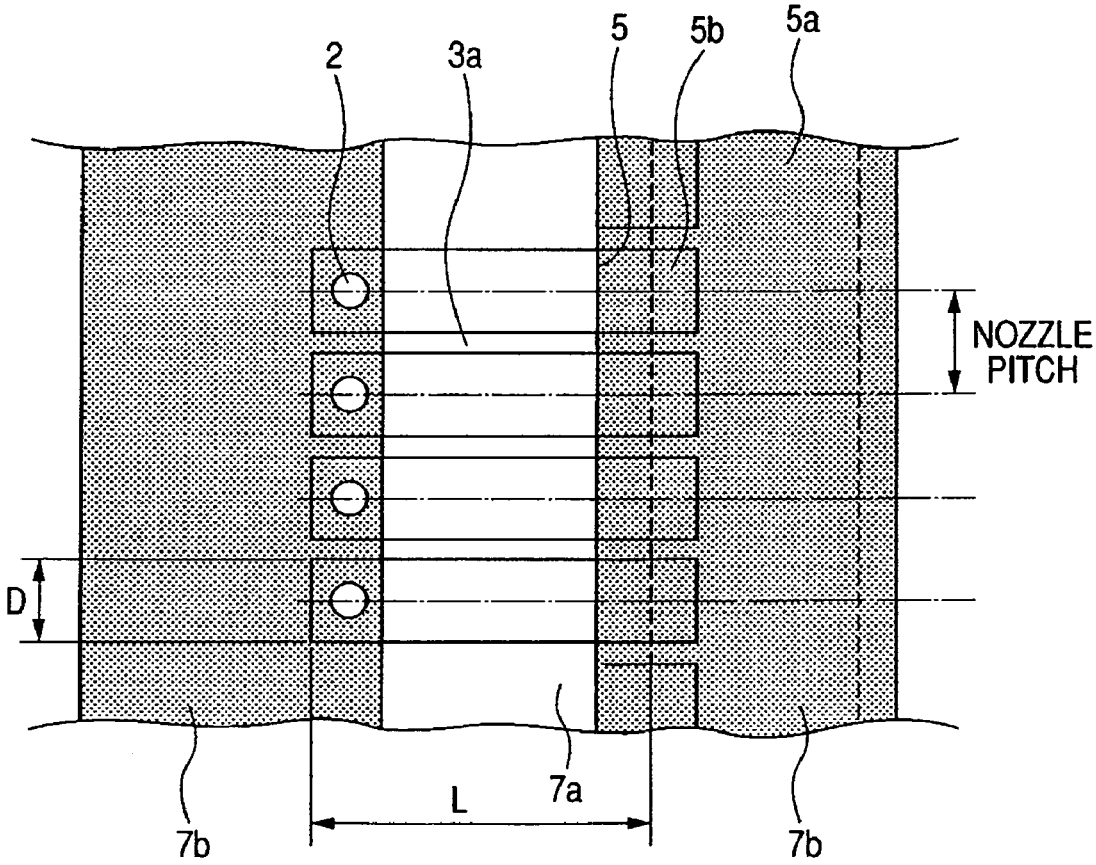
FIG. 2 is a schematic plan view explaining the arrangement of the vibration plate and an individual liquid chamber of the recording head of FIGS. 1A, 1B and 1C.

The etching mask for forming a pattern of the individual liquid chamber 5 is arranged on the front surface of the silicon substrate having a thickness of 400 μm, and the individual liquid chamber 5 having a depth of 100 μm, width (D) of 100 μm, and length (L) of 2500 μm is formed, as shown in FIG. 2, using the ICP etching device. The individual liquid chamber 5 is partitioned by an individual liquid chamber partitioning wall 3*a*.

The etching mask for forming a pattern of the communication port 4 is arranged on the back surface of the silicon substrate having a thickness of 400 μm. The communication port 4 having a depth of 300 μm is formed using the ICP etching device.

Thereafter, the vibration plate 7 is attached to the surface of the silicon substrate.

The piezoelectric element 6 is then formed on the vibration plate 7, and the nozzle plate 1 separately processed through punching process and the like from the SUS plate, etc., is attached to the back surface side of the silicon substrate.

A method for manufacturing the vibration plate 7 is as described below. As shown in FIG. 1C, after bonding the (100) silicon substrate 7B having the Young's modulus of 130 GPa and the heat resistance glass 7A of SD2 (anode bonding glass manufactured by HOYA) having the Young's modulus of 87 GPa through anode bonding, polishing was performed for thinning, and the vibration plate 7 having a thickness of 3 μm was obtained.

The following samples were prepared for comparison.

Comparative Example 1

Figure 17:
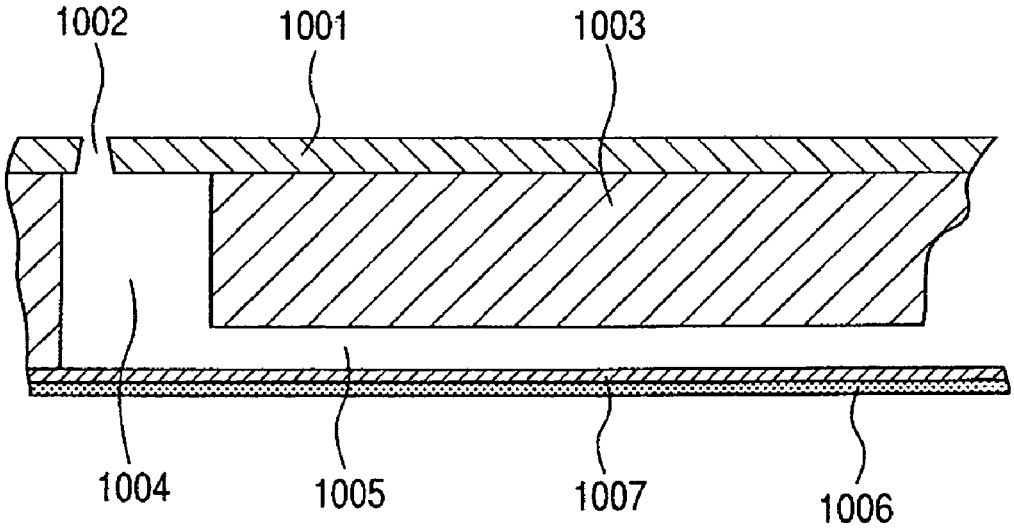
FIG. 17 is a partial cross-sectional view showing the main part of the recording head of prior art.
Figure 18:
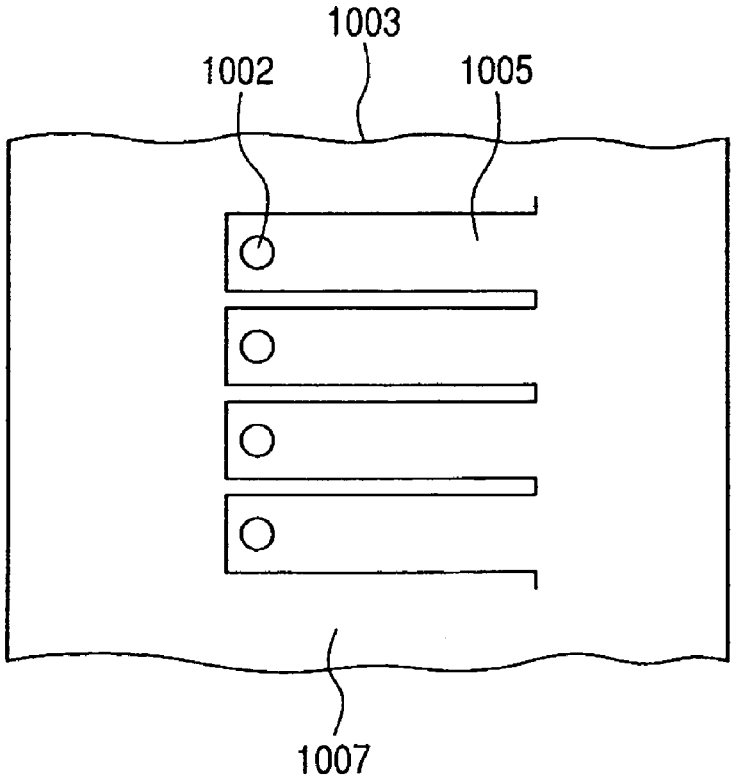
FIG. 18 is a schematic plan view explaining the arrangement of the vibration plate and an individual liquid chamber of the device of FIG. 17.

The recording head as shown in FIGS. 17 and 18 was produced with nozzle (discharge port) density of 150 dpi. The recording head includes a nozzle plate 1001 with nozzles 1002, a base body 1003 with a communication port 1004 and an individual liquid chamber 1005, a piezoelectric element 1006, and a vibration plate 1007. The width of the individual liquid chamber 1005 was about 100 μm, the length of the individual liquid chamber 1005 was about 2500 μm, and the plate thickness of the vibration plate 1007 was about 3 μm. A rectangular voltage waveform was applied to the recording head, and liquid discharging operation was repeated. As a result, liquid leakage was observed at one part of the vibration plate 1007 around the $3\times10^{9th}$ discharging operations.

Comparative Example 2

The recording head was produced with nozzle (discharge port) density of 150 dpi, similar to comparative example 1. The width of the individual liquid chamber was about 100 μm, the length of the individual liquid chamber was about 2500 μm, and the plate thickness of the vibration plate was about 5 μm.

The rectangular voltage waveform was applied to the recording head, and liquid discharging operation is repeated. As a result, liquid leakage was observed at one part of the vibration plate around the $5\times10^{9th}$ discharging operations.

Comparative Example 3

The recording head was produced with nozzle (discharge port) density of 150 dpi, similar to comparative example 1. The width of the individual liquid chamber was about 100 μm, the length of the individual liquid chamber was about 2500 μm, and the plate thickness of the vibration plate was about 7 μm.

The rectangular voltage waveform was applied to the recording head, and liquid discharging operation was repeated. As a result, liquid leakage was observed at one part of the vibration plate around the $7\times10^{9th}$ discharging operations.

The results of the comparative examples were closely reviewed to seek the causes, and the following points were revealed.

First, the time history data of the displacement of the surface of the vibration plate was taken using a non-contacting displacement gauge at a few points within 2500 μm in the longitudinal direction of the individual liquid chamber of comparative example 1 to grasp the displacement shape of the vibration plate. Since the thickness of the piezoelectric body and the electrode in the piezoelectric element is microscopic, the displacement of the surface of the piezoelectric element surface is assumed to be substantially the same as the displacement of the vibration plate.

Figure 3A:
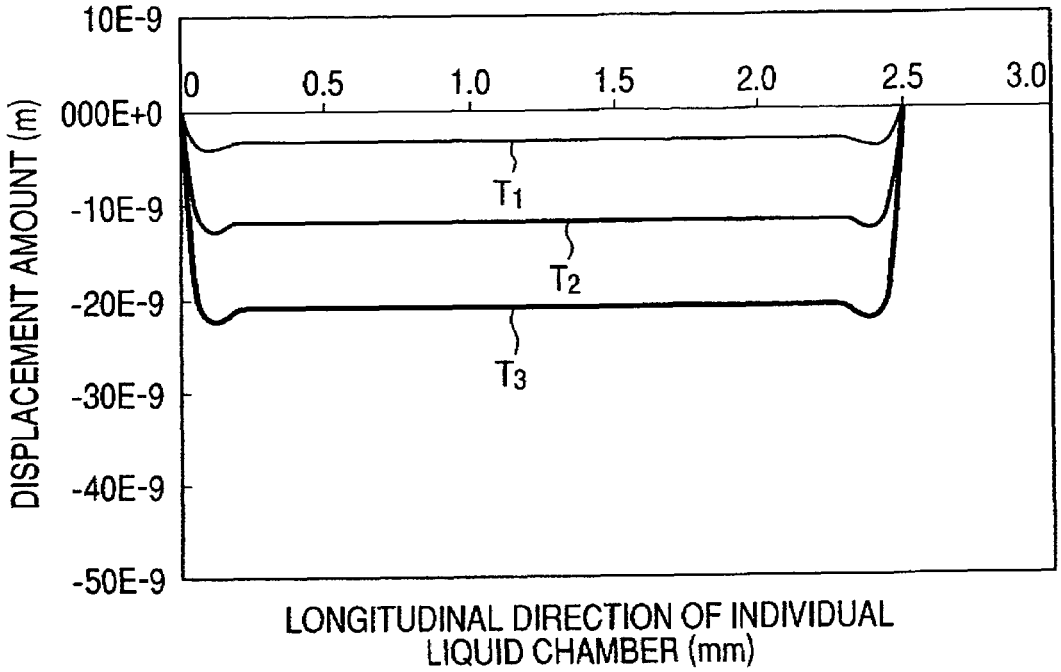
FIGS. 3A and 3B are graphs showing the displacement of the vibration plate, where

FIG. 3A is a graph where the coordinate in the longitudinal direction of the individual liquid chamber is plotted in the horizontal axis, and the displacement amount is plotted in the vertical axis. With regards to the displacement, the result of measuring the displacement of the surface of the vibration plate at the position of the central cross-section of the individual liquid chamber at time $t_1$, $t_2$, $t_3$ of the period in which the individual liquid chamber expands is shown as graphs $T_1$, $T_2$, $T_3$.

The displacement of the vibration plate does not deform into a convex shape of one mountain, but deforms into two mountain shape having horns at both ends. Although there is difference in degree, such state was observed in all comparative examples 1 to 3. The portion of the horn at both ends receives a greater bend compared to other portions, and the bending state that is severe for the thin vibration plate is repeatedly added, whereby breakage is likely to occur.

A method of suppressing the two mountains having horns formed at both ends in the longitudinal direction of the individual liquid chamber includes changing the material of the vibration plate to a material having a large Young's modulus. However, this method also reduces the displacement amount of the vibration plate of the central portion in the longitudinal direction of the individual liquid chamber, and a satisfactory discharge cannot be ensured.

Thus, in the present example, the vibration plate material having a large Young's modulus is used for the portion at both ends in the longitudinal direction of the individual liquid chamber, and the vibration plate material having a small Young's modulus is used for the central portion in the longitudinal direction of the individual liquid chamber in aim of suppressing the two mountains of horn shape produced at both ends in the longitudinal direction of the individual liquid chamber. The method for measuring the Young's modulus includes the known "film distortion method", "pushing test method", "Brillouin scattering method", "ultrasonic microscopic method", "resonance oscillation method", "surface elastic wave method" and the like.

The preferred range of the Young's modulus of the vibration plate will now be observed. The lower limit of the Young's modulus must be a value sufficient to flow (flow against weight of liquid) the "liquid present at a certain mass (or weight)" into the individual liquid chamber. As for the upper limit of the Young's modulus, it is more suitable the larger the value for the purpose of preventing damage of the vibration plate. Although it seems to be limited by the lowering of the displacement amount, lowering of the displacement amount is improved by widening the width of the individual liquid chamber, and can be improved by further thinning the thickness of the vibration plate. Therefore, as long as the material is suitable for producing the recording head, the material having the largest Young's modulus that exists in the world can be used in the present embodiment.

Figure 3B:
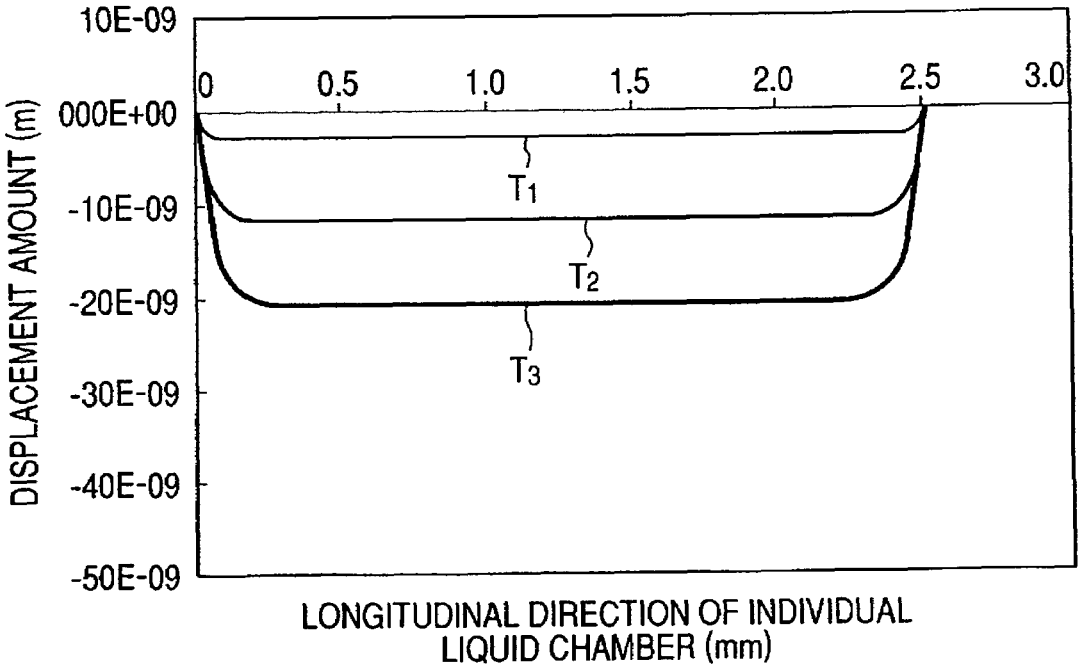

The experiment result of example 1 is as follows. The rectangular voltage waveform was applied to the recording head of example 1, and the liquid discharging operation was repeated. As a result, liquid leakage was observed at one part of the vibration plate around the $2\times10^{10}$th discharging operation, but the lifetime was enhanced compared to comparative example 1. Similar to comparative example 1, the time history data of the displacement of the surface of the vibration plate was taken using the non-contacting displacement gauge at a few points within 2500 μm in the longitudinal direction of the individual liquid chamber. As a result, the two mountains of horn shape produced at both ends in the longitudinal direction of the individual liquid chamber, as shown in FIG. 3B, were suppressed, and thus severe bending state was not added as a consequence, and the lifetime is assumed to have been extended.

Example 2

After bonding the (100) silicon having Young's modulus of 130 GPa and SD2 (anode bonding glass manufactured by HOYA) having Young's modulus of 87 GPa through anode bonding, polishing was performed for thinning, and the vibration plate having a thickness of 5 μm was obtained. The other producing methods are the same as comparative example 2.

The rectangular voltage waveform was applied to the recording head and the liquid discharging operation was repeated. As a result, liquid leakage was observed at one part of the vibration plate around the $3\times10^{10}$th discharging operation, but the lifetime was enhanced compared to comparative example 2. In the result of taking the time history data of the displacement of the surface of the vibration plate, the two mountains of horn shape produced at both ends in the longitudinal direction of the individual liquid chamber were suppressed, and thus severe bending state was not added as a consequence, and the lifetime is assumed to have been extended.

Example 3

After bonding the (100) silicon having Young's modulus of 130 GPa and SD2 (anode bonding glass manufactured by HOYA) having Young's modulus of 87 GPa through anode bonding, polishing was performed for thinning, and the vibration plate having a thickness of 7 μm was obtained. The other producing methods are the same as comparative example 3.

The rectangular voltage waveform was applied to the recording head and the liquid discharging operation was repeated. As a result, liquid leakage was observed at one part of the vibration plate around the $4\times10^{10}$th discharging operation, but the lifetime was enhanced compared to comparative example 3. In the result of taking the time history data of the displacement of the surface of the vibration plate, the two mountains of horn shape produced at both ends in the longitudinal direction of the individual liquid chamber were suppressed, and thus severe bending state was not added as a consequence, and the lifetime is assumed to have been extended.

Example 4

After bonding the (111) silicon having Young's modulus of 190 GPa and SD2 (anode bonding glass manufactured by HOYA) having Young's modulus of 87 GPa through anode bonding, polishing was performed for thinning, and the vibration plate having a thickness of 5 μm was obtained. The other producing methods are the same as comparative example 2.

The rectangular voltage waveform was applied to the recording head and the liquid discharging operation was repeated. As a result, liquid leakage was observed at one part of the vibration plate around the $5\times10^{10}$th discharging operation, but the lifetime was enhanced compared to comparative example 2. In the result of taking the time history data of the displacement of the surface of the vibration plate, the two mountains of horn shape produced at both ends in the longitudinal direction of the individual liquid chamber were suppressed, and thus severe bending state was not added as a consequence, and the lifetime is assumed to have been extended.

Example 5

Figure 4:
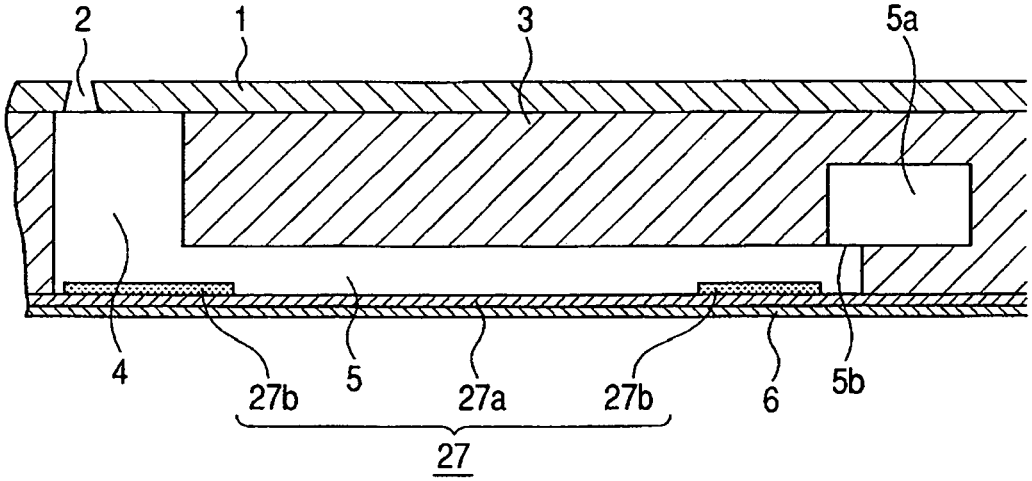
FIG. 4 is a partial cross-sectional view showing the main part of a recording head according to a fifth example.
Figure 5:
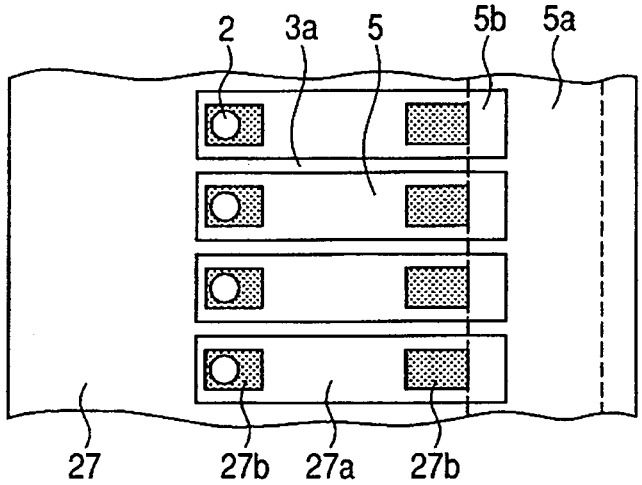
FIG. 5 is a schematic plan view explaining the arrangement of the vibration plate and an individual liquid chamber of the recording head.

As shown in FIGS. 4 and 5, the (100) silicon substrate 27*a* having a thickness of 5 μm and the Young's modulus of 130 GPa was considered as the base of the vibration plate 27. A thin film 27*b* of SiN (Young's modulus of 267 GPa) was grown and stacked by sputtering and the like on the second region positioned on both ends of the first region contacting the liquid at the central part of the individual liquid chamber 5 of the silicon substrate 27*a*. The stacked configuration not only enhances bending rigidity by increasing the Young's modulus as a total, but also aims to enhance bending rigidity by increasing the thickness as a total. This vibration plate 27 was bonded with the base body 3 of silicon through anode bonding. The other producing methods are the same as comparative example 2.

The rectangular voltage waveform was applied to the recording head and the liquid discharging operation was repeated. As a result, the lifetime was enhanced compared to when the (100) silicon single body is made as the vibration plate of 5 μm. Similar to comparative example 2, the time history data of the displacement of the surface of the vibration plate was taken using the non-contacting displacement gauge at a few points within 2500 μm in the longitudinal direction of the individual liquid chamber 5. As a result, the two mountains of horn shape produced at both ends in the longitudinal direction of the individual liquid chamber 5 were suppressed, and thus severe bending state was not added as a consequence, and the lifetime is assumed to have been extended.

Example 6

Figure 6:
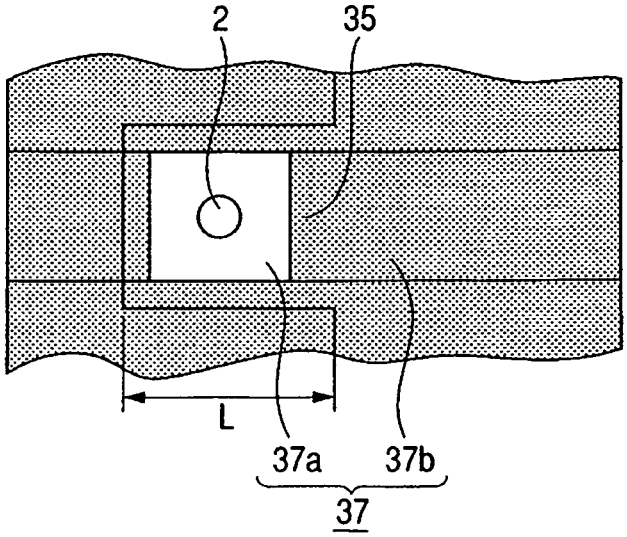
FIG. 6 is a schematic plan view explaining the arrangement of the vibration plate and an individual liquid chamber of the recording head of example 6.

As shown in FIG. 6, the nozzle density is made to 80 dpi (width of individual liquid chamber 5 is 270 μm), and the recording head including an individual liquid chamber 35 having a short length of 500 μm was produced in aim of greatly increasing the drive frequency. In this case, even if the thickness of the vibration plate 37 is not as thin as in examples 1 to 5, the end supporting distance is long in the longitudinal direction and the width direction (direction orthogonal to the arranging direction of one electrode layer) of the individual liquid chamber 35. Thus, deformation as shown in FIG. 3A was observed for both the longitudinal direction and the width direction of the individual liquid chamber 35.

Similar to examples 1 to 4, the vibration plate 37 including the first region 37*a* made of silicon and the second region 37*b* made of SD2 was produced by repeating bonding and polishing of (100) silicon or (111) silicon and SD2, and the recording head was produced. In this case, the second region 37*b* of the vibration plate 37 was formed by silicon, and the Young's modulus of which portion is relatively large.

The rectangular voltage waveform was applied to the recording head and the liquid discharging operation was repeated. As a result, the lifetime was enhanced compared to the recording head in which the vibration plate was produced only with SD2. Further, the time history data of the displacement of the surface of the liquid chamber volume control means was taken using the non-contacting displacement gauge at a few points in the longitudinal direction and the width direction of the individual liquid chamber. As a result, as shown in FIG. 3B, the two mountains of horn shape produced at both ends in the longitudinal direction and the width direction of the individual liquid chamber were suppressed, and thus severe bending state was not added as a consequence, and the lifetime is assumed to have been extended.

In examples 1 to 4 and example 6, the vibration plate was produced by the bonding technique and polishing, but may be produced with other techniques.

Example 7

Figure 7A:
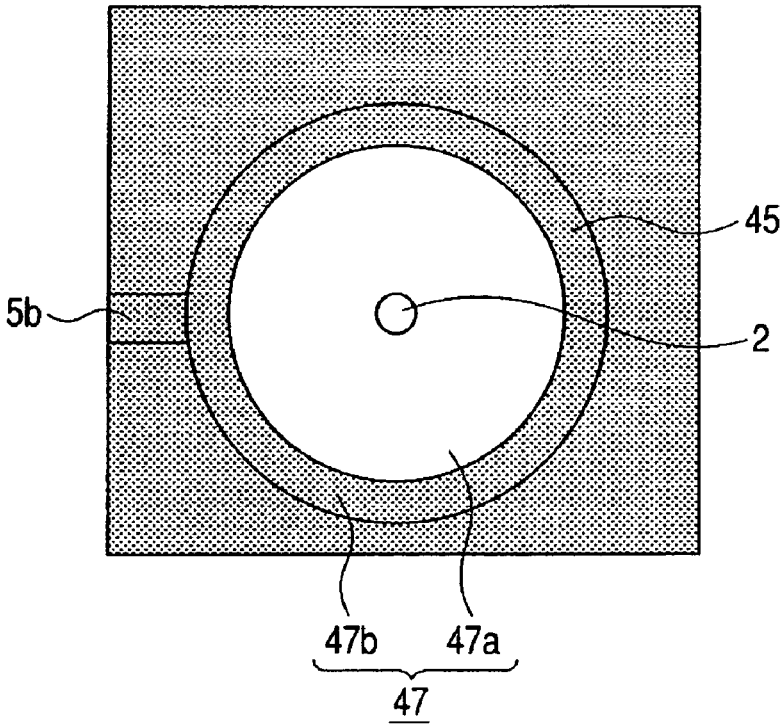
FIGS. 7A and 7B are schematic plan views explaining the arrangement of the vibration plate and an individual liquid chamber of the recording head of example 7.
Figure 7B:
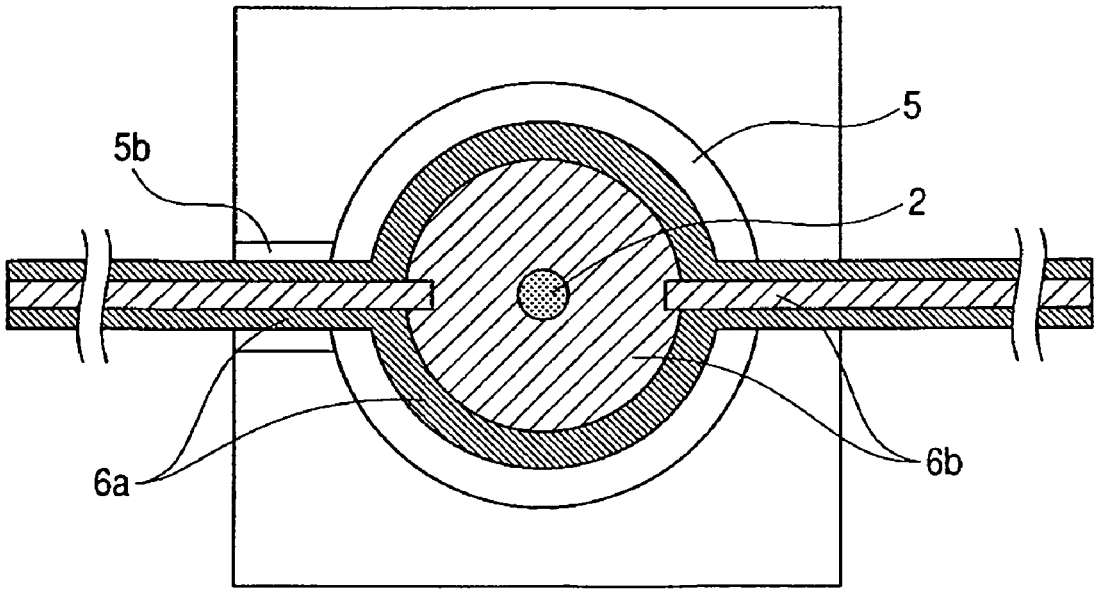

As shown in FIGS. 7A and 7B, if the outer shapes of the individual liquid chamber 45 and the vibration plate 47 facing thereto are circular or substantially circular, the second region 47*b* having a large Young's modulus is concentrically arranged with respect to the first region 47*a* at the center.

Example 8

Figure 8:
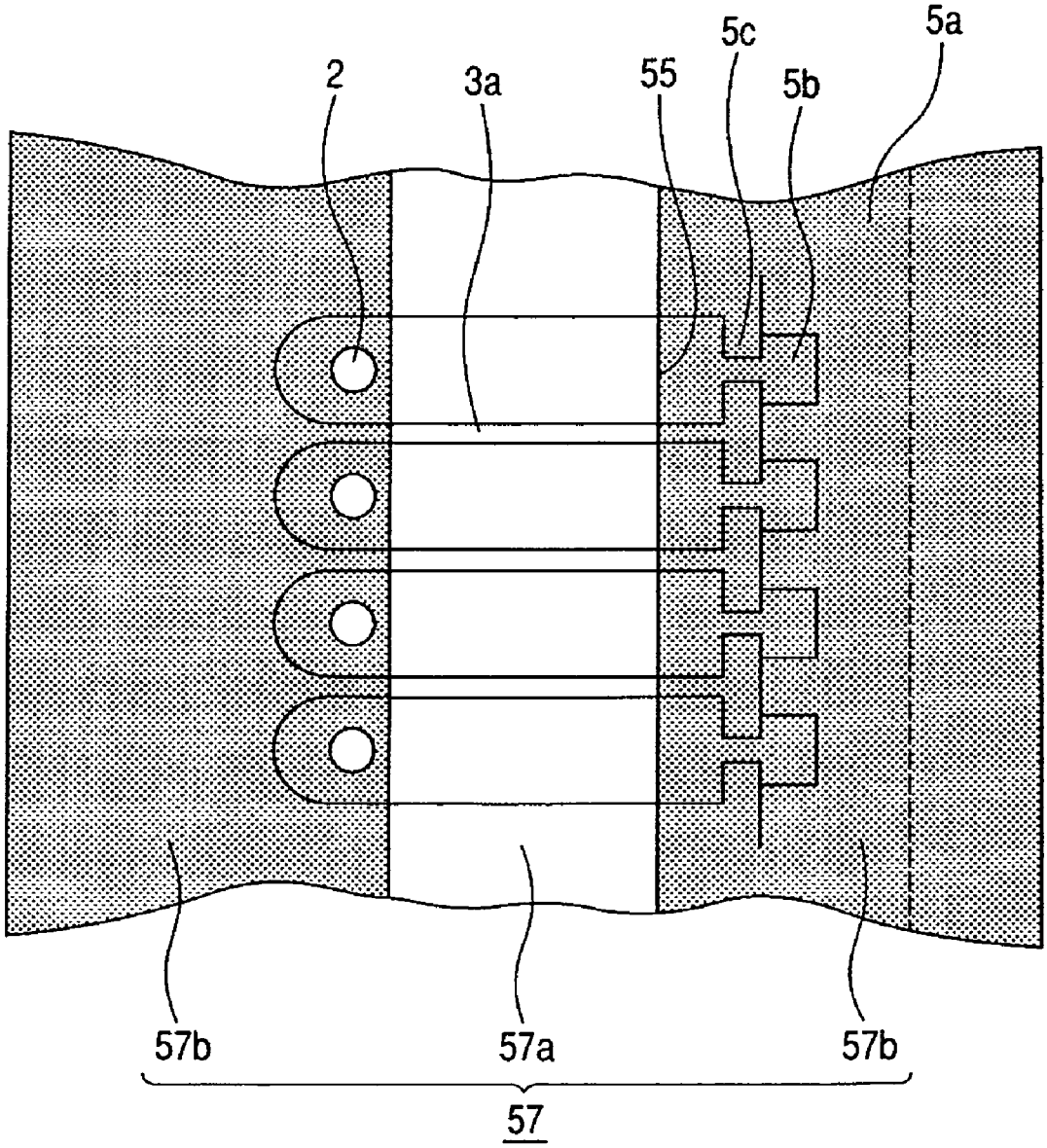
FIG. 8 is a schematic plan view explaining the arrangement of the vibration plate and an individual liquid chamber of the recording head of example 8.

As shown in FIG. 8, similar effects are obtained even if the ends of the individual liquid chamber 55 are an R shape without horns by using the material having a larger Young's modulus for the second region 57*b* than that for the first region 57*a* of the vibration plate 57 as in examples 1 to 3. In the present example, the liquid chamber 5 is tightened by a tightening section 5*c*. Thus, the pressure cross-talk between individual liquid chambers is made smaller.

Example 9

The embodiment of the present invention will now be described based on the figures.

Figure 9:
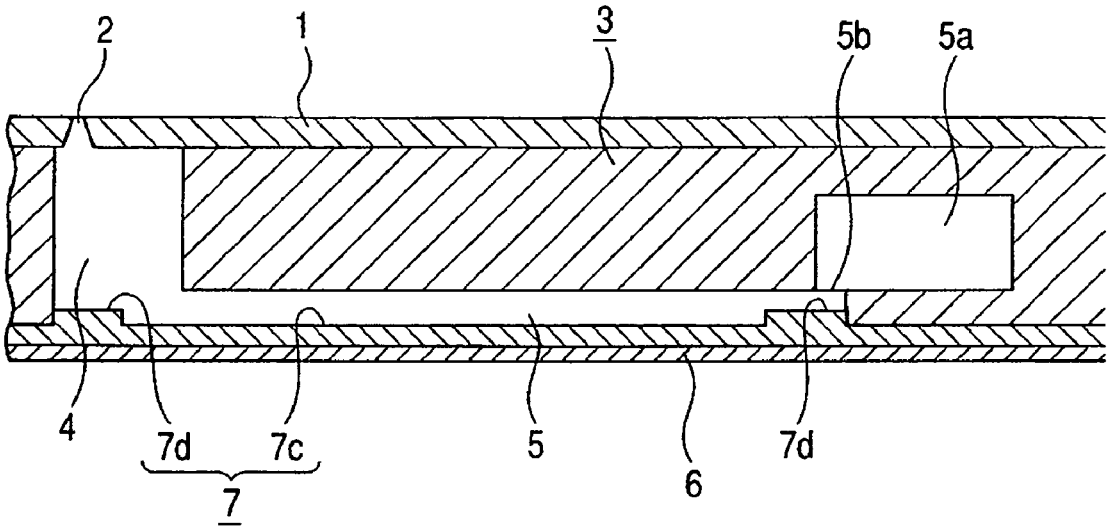
FIG. 9 is a frame format cross-sectional view explaining a liquid discharge head according to an example 9 of the present invention.
Figure 10:
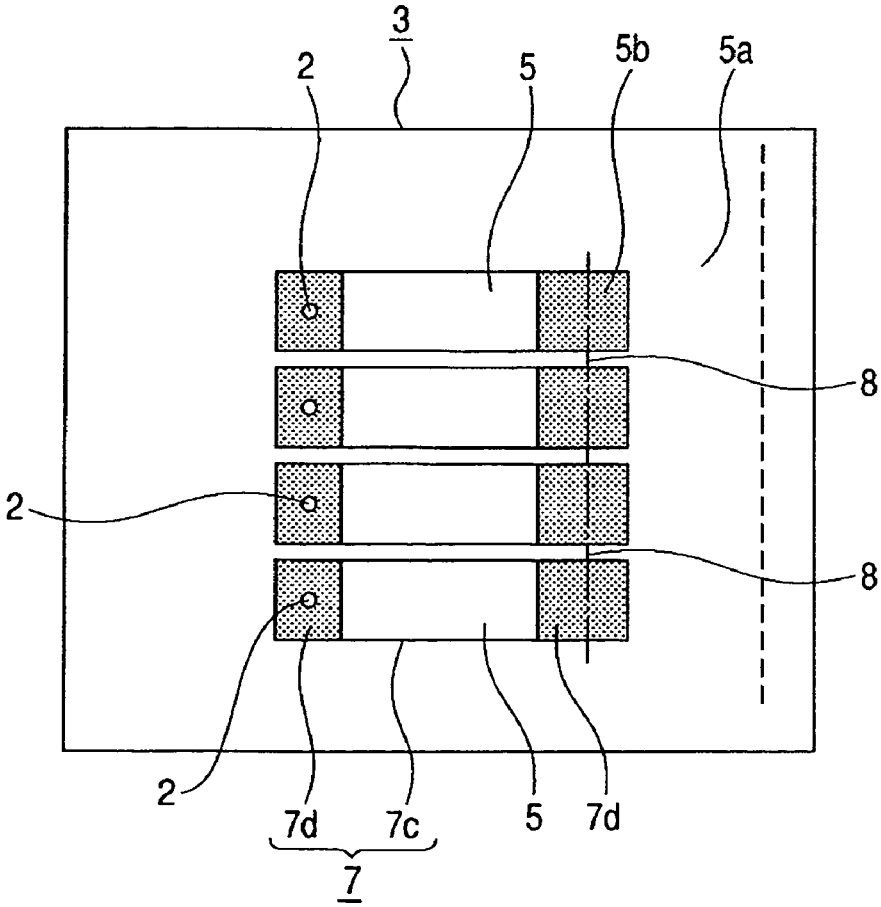
FIG. 10 is a schematic plan view explaining the liquid discharge head according to the example 9 of the present invention.

As shown in FIGS. 9 and 10, the liquid discharge head according to the present invention has the individual liquid chamber 5 or the liquid chamber formed in the base body 3 communicated to a plurality of discharge ports 2 formed in the nozzle plate 1 by way of the communication port 4.

The piezoelectric element 6 is arranged in each individual liquid chamber 5, and the vibration plate 7 for conveying displacement by the piezoelectric element 6 to the liquid in the individual liquid chamber 5 is interposed between the piezoelectric element 6 and the individual liquid chamber 5.

The vibration plate 7 includes a thick thickness part 7*d* arranged in a region contacting the liquid in the individual liquid chamber 5, the region corresponding to both ends in the longitudinal direction of the individual liquid chamber 5; and a thin thickness part 7*c* arranged in a region contacting the liquid in the individual liquid chamber 5, the region corresponding to the central region of the individual liquid chamber 5. The thickness of the thick thickness part 7*d* is set to be thicker than the thin thickness part 7*c* to prevent breakage of the vibration plate 7.

The present example illustrates the recording head serving as the liquid discharge head shown in FIGS. 9 and 10 produced by the method described below.

First, the etching mask for patterning of the individual liquid chamber 5 made of oxidized film having a thickness of 1 μm is formed on the surface of the base body 3 of the silicon substrate and the like having a thickness of 400 μm through photolithography. Thereafter, the individual liquid chamber 5 partitioned by a partition wall 8 and having a depth of 100 μm is formed by the ICP (Inductively Coupled Plasma) etching device using $SF_6$, $C_4F_8$ as the etching gas.

After forming the etching mask for patterning of the communication port 4 on the back surface of the base body 3, the communication port 4 partitioned by the partitioning wall 8 and having a depth of 300 μm is formed using the ICP etching device.

The vibration plate 7 is then attached to the surface of the base body 3 through anode bonding, and polishing is performed to obtain a desired plate thickness.

The vibration plate 7 is made of the anode bonding glass SD2 (manufactured by HOYA), and is produced through the method described below.

Figure 11A:
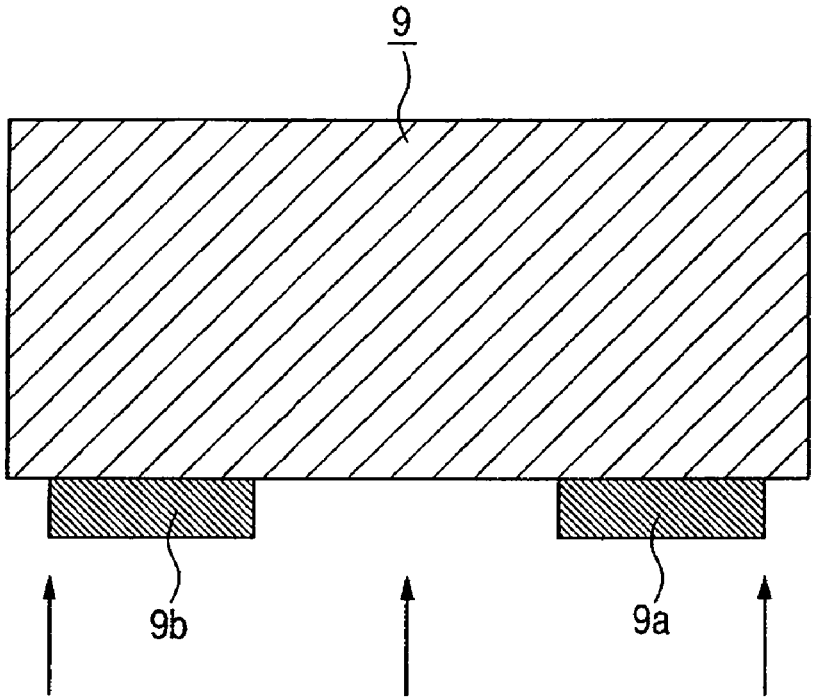
FIGS. 11A and 11B are frame format cross-sectional views explaining a method for forming a vibration plate according to an example of the present invention.
Figure 11B:
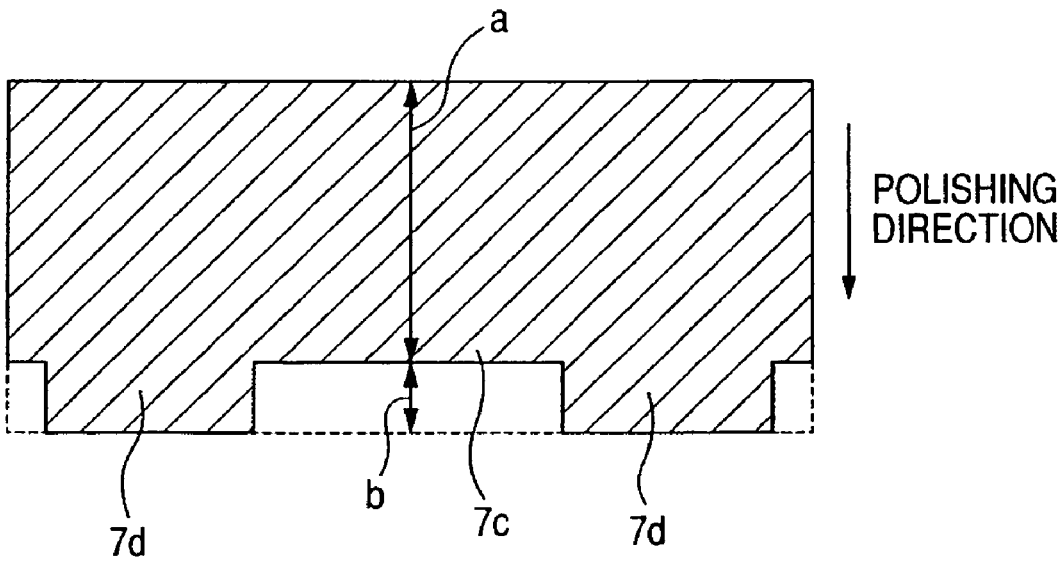

As shown in FIGS. 11A and 11B, after forming the photoresist 9*a*, 9*b* corresponding to the thick thickness part 7*d* of the vibration plate 7 on the substrate 9, etching is performed to a depth of 2 μm. Low concentration hydrofluoric acid solution was used as the etchant.

The remaining photoresist was then removed, and attached to the surface of the base body 3 through anode bonding, and made to a desired thickness by polishing, as shown in FIG. 11B. Thus, the vibration plate 7 in which the thickness of the thick thickness part 7*d* is 5 μm and the thickness of the thin thickness part is 3 μm was obtained.

The piezoelectric element 6 is formed on the vibration plate 7, and the nozzle plate 1 separately processed through punching process and the like from the SUS plate and the like is attached to the back surface of the base body 3.

The rectangular voltage waveform was applied to the recording head according to the present example and the liquid discharge operation was repeated. As a result, liquid leakage was observed at one part of the vibration plate around the $N_4=2\times10^{10}$th ($>N_1$) discharging operation, but the lifetime was extended compared to the comparative examples to be hereinafter described.

The result of taking the time history data of the displacement of the surface of the vibration plate using the non-contacting displacement gauge at a few points within 2500 μm in the longitudinal direction of the individual liquid chamber 5 was close to that shown in FIG. 3B. As shown in FIG. 3B, the two mountains of horn shape (see FIG. 3A) produced at the region corresponding to both ends in the longitudinal direction of the individual liquid chamber 5 of the vibration plate 7 were suppressed, and thus severe bending state was not added as a consequence, and the lifetime is assumed to have been extended.

Example 10

In the present example, as shown in FIG. 11A, after forming the photoresist 9*a*, 9*b* corresponding to the thick thickness part 7*d* of both ends in the longitudinal direction of the vibration plate 7 with respect to the substrate 9, etching was performed to a depth of 4 μm corresponding to the thin thickness part 7*c* of the central region in the longitudinal direction of the vibration plate 7. Low concentration hydrofluoric acid solution was used as the etchant.

The remaining photoresist was then removed, and attached to the surface of the base body 3 through anode bonding, and thereafter, polishing was performed to obtain the desired thickness, as shown in FIG. 11B. Thus, the vibration plate 7 in which the thickness of the thick thickness part 7*d* of the vibration plate is 7 μm and the thickness of the thin thickness part 7*c* corresponding to the central region in the longitudinal direction of the individual liquid chamber 5 is 3 μm was obtained. Other steps are the same as example 9, and thus the explanation thereof is omitted.

The rectangular voltage waveform was applied to the recording head according to the present example and the liquid discharge operation was repeated. As a result, liquid leakage was observed at one part of the vibration plate 7 around the $N_5=3\times10^{10}$th ($>N_1$) discharging operation, but the lifetime was extended compared to the comparative examples.

The result of taking the time history data of the displacement of the surface of the vibration plate using the non-contacting displacement gauge at a few points within 2500 μm in the longitudinal direction of the individual liquid chamber 5 was close to that shown in FIG. 3B. As shown in FIG. 3B, the two mountains of horn shape produced at the region corresponding to both ends in the longitudinal direction of the individual liquid chamber 5 of the vibration plate 7 were suppressed, and thus severe bending state was not added as a consequence, and the lifetime is assumed to have been extended.

Example 11

In the present example, after forming the photoresist corresponding to the thick thickness part 7*d* of the vibration plate 7 with respect to the substrate 9, etching was performed to a depth of 6 μm corresponding to the central region in the longitudinal direction of the vibration plate 7. Low concentration hydrofluoric acid solution was used as the etchant.

The remaining photoresist was then removed, and attached to the surface of the base body 3 through anode bonding to obtain the desired thickness by polishing, as shown in FIG. 11B. Thus, the vibration plate 7 in which the thickness of the thick thickness part 7*d* of the vibration plate 7 is 9 μm and the thickness of the thin thickness part 7*c* is 3 μm was obtained. Other steps are the same as example 9, and thus the explanation thereof is omitted.

The rectangular voltage waveform was applied to the recording head according to the present example and the liquid discharge operation was repeated. As a result, liquid leakage was observed at one part of the vibration plate around the $N_6=4\times10^{10}$th ($>N_1$) discharging operation, but the lifetime was extended compared to the comparative examples.

The result of taking the time history data of the displacement of the surface of the vibration plate using the non-contacting displacement gauge at a few points within 2500 μm in the longitudinal direction of the individual liquid chamber 5 was close to that shown in FIG. 3B. As shown in FIG. 3B, the two mountains of horn shape produced at the region corresponding to both ends in the longitudinal direction of the individual liquid chamber 5 were suppressed, and thus severe bending state was not added as a consequence, and the lifetime is assumed to have been extended.

Example 12

Figure 12:
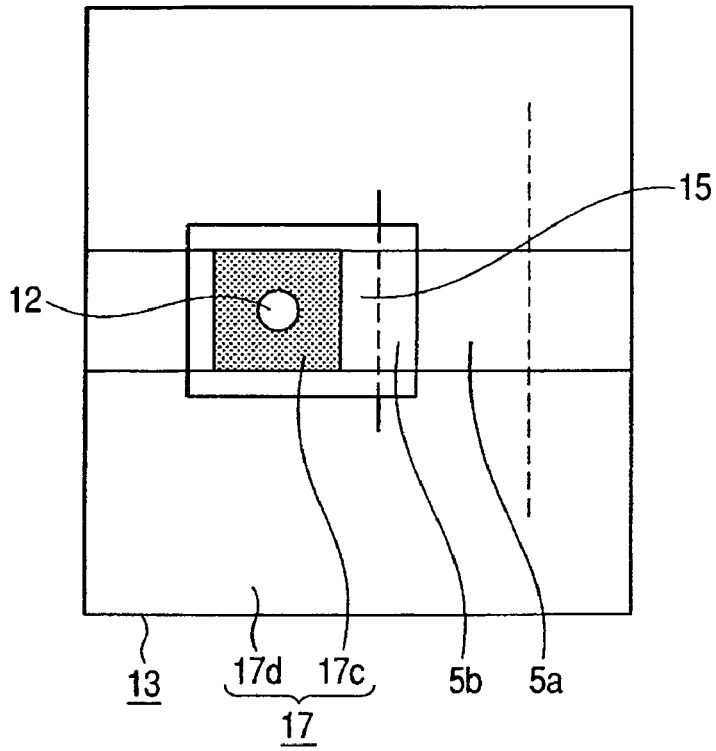
FIG. 12 is a schematic plan view explaining a liquid discharge head according to example 12 of the present invention.

In an aim of greatly enhancing the drive frequency instead of mounting the nozzles (discharge ports) at high density, the recording head having an extremely short individual liquid chamber 15 as shown in FIG. 12 was produced with a method similar to example 9 (80 dpi). The individual liquid chamber 15 has a length of 500 μm and a width of 270 μm. In such mode of the prior art, deformation as shown in FIG. 3A was observed both in the longitudinal direction and the width direction of the individual liquid chamber 15.

As shown in FIG. 12, the vibration plate 17 of the present embodiment has a region contacting the liquid in the individual liquid chamber 15, which inner side region corresponding to the discharge port 12 configured by the thin thickness part 17*c*, and the outer side of the thin thickness part 17*c* is surrounded by the thick thickness part 17*d*. In this case, the thick thickness part 17*d* is made thicker than the thin thickness part 17*c* arranged on the inner side region corresponding to the discharge port 12.

The rectangular voltage waveform was applied to the recording head according to the present example and the liquid discharge operation was repeated. As a result, the lifetime was extended compared to the recording head in which the vibration plate was produced at an even thickness. The result of taking the time history data of the displacement of the surface of the vibration plate using the non-contacting displacement gauge at a few points within 500 μm in the longitudinal direction and the width direction of the individual liquid chamber 15 was close to that shown in FIG. 3B. As shown in FIG. 3B, the two mountains of horn shape produced at the region corresponding to both ends in the longitudinal direction and the width direction of the individual liquid chamber 15 were suppressed, and thus severe bending state was not added as a consequence, and the lifetime is assumed to have been extended.

Comparative Example 4

The recording head of the present comparative example is shown in FIGS. 17 and 18. In the present comparative example, the density of the discharge port (nozzle) 202 is 150 dpi, the width of the individual liquid chamber 205 is about 100 μm, the length of the individual liquid chamber 205 is about 2500 μm, and the plate thickness of the vibration plate 207 is about 3 μm.

An outline of a method for producing the recording head according to the present comparative example will now be described.

First, the etching mask for patterning of the individual liquid chamber 205 is formed on the surface of the base body 203 of the silicon substrate and the like having a thickness of 400 μm through photolithography. Thereafter, the individual liquid chamber 205 partitioned by a partition wall 208 and having a depth of 100 μm is formed by the ICP etching device using $SF_6$, $C_4F_8$ as the etching gas.

After forming the etching mask for patterning of the communication port 204 on the back surface of the base body 203, the communication port 204 partitioned by the partitioning wall 208 and having a depth of 300 μm is formed using the ICP etching device.

The vibration plate 207 is then attached to the surface of the base body 203, and polishing is performed to obtain a desired plate thickness.

The anode bonding glass SD2 (manufactured by HOYA) is used for the vibration plate 207.

The volume changing means (piezoelectric element) 206 on the vibration plate 207 is formed, and the nozzle plate 201 separately processed through punching process and the like from the SUS plate and the like is attached to the back surface of the base body 203.

The rectangular voltage waveform was applied to the liquid discharge head and the liquid discharge operation was repeated. As a result, liquid leakage was observed at one part of the vibration plate 207 around the $N_1=3\times10^9$th discharging operation.

Comparative Example 5

The recording head according to the present comparative example is the same as comparative example 4 except for the fact that the plate thickness of the vibration plate 207 is about 5 μm.

The rectangular voltage waveform was applied to the recording head and the liquid discharge operation was repeated. As a result, liquid leakage was observed at one part of the vibration plate 207 around the $N_2=5\times10^9$th ($>N_1$) discharging operation.

Comparative Example 6

The recording head according to the present comparative example is the same as comparative example 4 except for the fact that the plate thickness of the vibration plate 207 is about 7 μm.

The rectangular voltage waveform was applied to the recording head and the liquid discharge operation was repeated. As a result, liquid leakage was observed at one part of the vibration plate 207 around the $N_3=7\times10^9$th ($>N_2>N_1$) discharging operation.

The results of the above comparative example were as predicted, but were closely reviewed to seek out the causes, and the following points were revealed.

First, the time history data of the displacement of the surface of the volume changing means was taken using a non-contacting displacement gauge at a few points within 2500 μm in the longitudinal direction of the individual liquid chamber to grasp the displacement shape of the vibration plate. Since the thickness of the piezoelectric body and the electrode in the volume changing means is microscopic, the displacement of the surface of the volume changing means is assumed to be substantially the same as the displacement of the vibration plate.

The result of a graph where the coordinate in the longitudinal direction of the individual liquid chamber is plotted in the horizontal axis, and the displacement amount is plotted in the vertical axis was close to that in FIG. 3A. With regards to the displacement of FIG. 3A, the displacement of the surface of the volume changing means at the position of the central cross-section of the individual liquid chamber is shown at time $t_1$, $t_2$, $t_3$ ($t_1<t_2<t_3$) of the period in which the individual liquid chamber expands.

The displacement of the surface of the volume changing means (the displacement of vibration plate) does not deform into a convex shape of one mountain, but deforms into a two mountain shape having horns at both ends. Although there is difference in degree, such state was observed in all comparative examples 4 to 6. The portion of the horn at both ends receives a greater bend compared to other portions, and the bending state that is severe for the thin vibration plate is repeatedly added, whereby breakage is likely to occur.

Other examples of the liquid discharge head according to the present invention will now be explained.

Example 13

Figure 13:
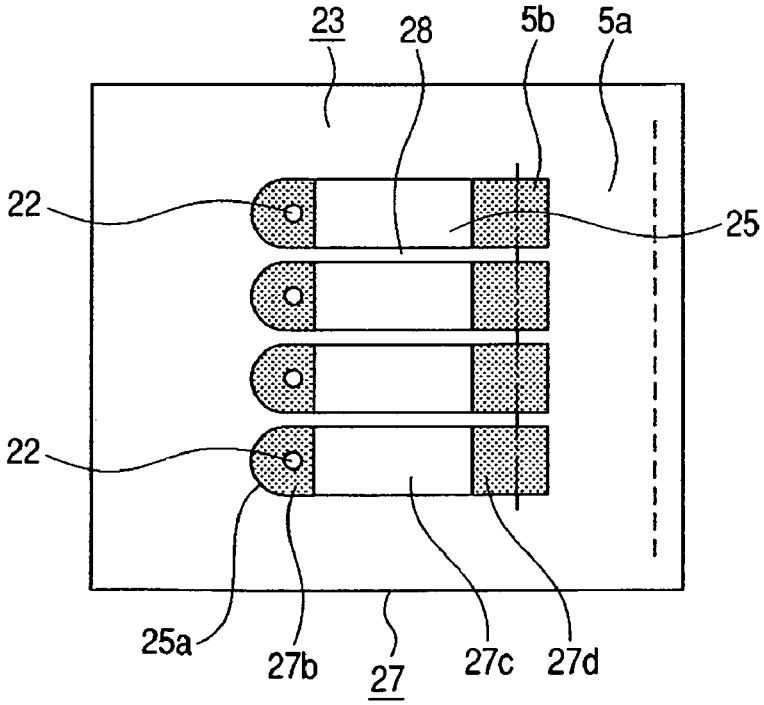
FIG. 13 is a schematic plan view explaining a liquid discharge head according to example 13 of the present invention.

As shown in FIG. 13, the present invention is also effective for the liquid discharge head in which the end 25*a* on the discharge port side of the individual liquid chamber 25 is an arc shaped liquid discharge head without horns. In the present example, the thick thickness part 27*d* is formed in the region contacting the liquid in the individual liquid chamber 25 of the vibration plate 27, the region corresponding to both ends in the longitudinal direction of the individual liquid chamber according to the liquid discharge head of example 9 shown in FIGS. 9 and 10 described above. The thin thickness part 27*c* is arranged in the region contacting the liquid in the individual liquid chamber 25 of the vibration plate 27, the region corresponding to the central region in the longitudinal direction of the individual liquid chamber.

Example 14

Figure 14:
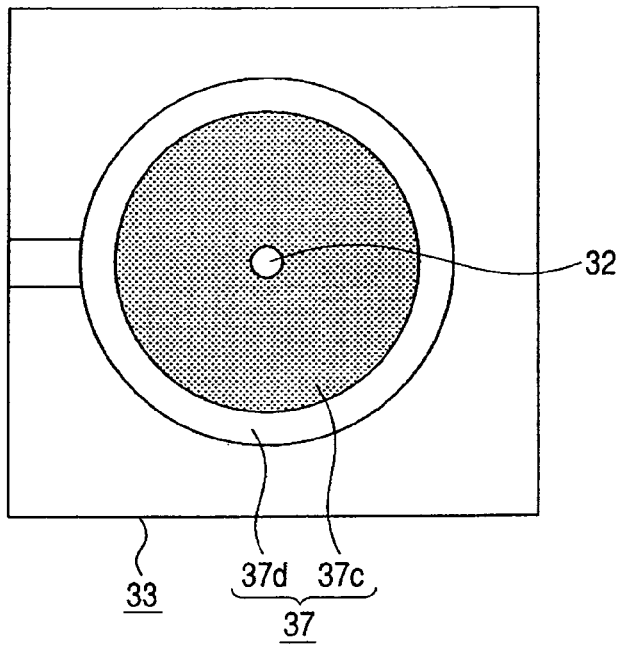
FIG. 14 is a schematic plan view explaining a liquid discharge head according to example 14 of the present invention.

As shown in FIG. 14, the present invention is also effective for the liquid discharge head in which the region contacting the liquid in the individual liquid chamber of the vibration plate 37 is circular or substantially circular. In the present example, the vibration plate 37 has the thick thickness part 37*d* concentrically surrounding the outer periphery of the thin thickness part 37*c* of the central region.

Example 15

Figure 15:
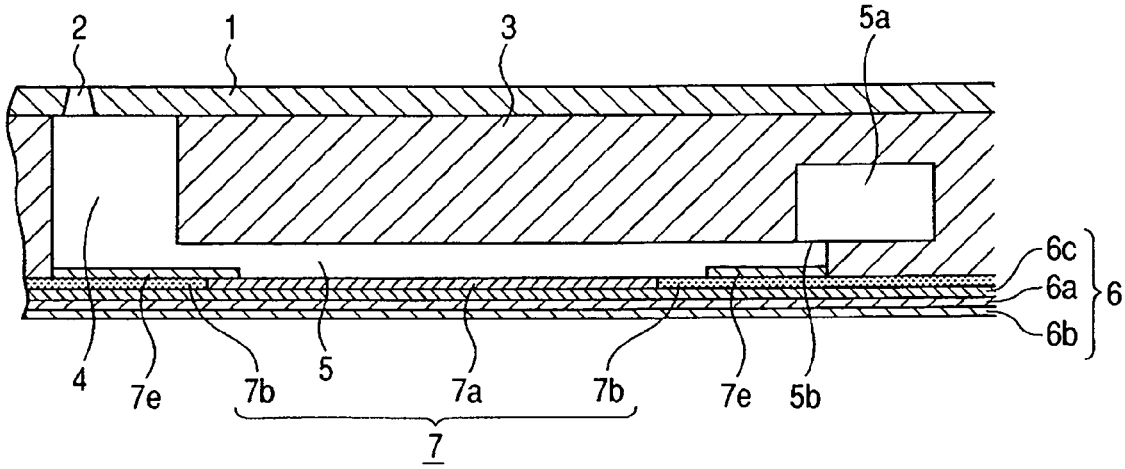
FIG. 15 is a schematic plan view explaining a liquid discharge head according to example 15 of the present invention.

After bonding the (100) silicon having Young's modulus of 130 GPa and SD2 (anode bonding glass manufactured by HOYA) having Young's modulus of 87 GPa through anode bonding, polishing was performed for thinning, and the vibration plate having a thickness of 5 μm was obtained. Further, the thin film 7*e* of SiN (Young's modulus of 267 GPa) was grown and stacked by sputtering and the like on the second region positioned on both ends of the first region contacting the liquid at the central part of the individual liquid chamber of the vibration plate (FIG. 15). The stacked configuration not only enhances bending rigidity by increasing the Young's modulus as a total, but also aims to enhance bending rigidity by increasing the thickness as a total. Therefore, the SiN that is grown and stacked is not limited to (100) silicon region, and may be positioned in a region across the (100) silicon and the SD2. This vibration plate was bonded to the base body of silicon through anode bonding. The other producing methods are the same as comparative example 2.

The rectangular voltage waveform was applied to the recording head and the liquid discharging operation was repeated. As a result, the lifetime enhanced compared to when the (100) silicon single body is made as the vibration plate of 5 μm. Similar to comparative example 2, the time history data of the displacement of the surface of the vibration plate was taken using the non-contacting displacement gauge at a few points within 2500 μm in the longitudinal direction of the individual liquid chamber. As a result, the two mountains of horn shape produced at both ends in the longitudinal direction of the individual liquid chamber 5 were suppressed, and thus severe bending state was not added as a consequence, and the lifetime is assumed to have been extended.

Figure 16:
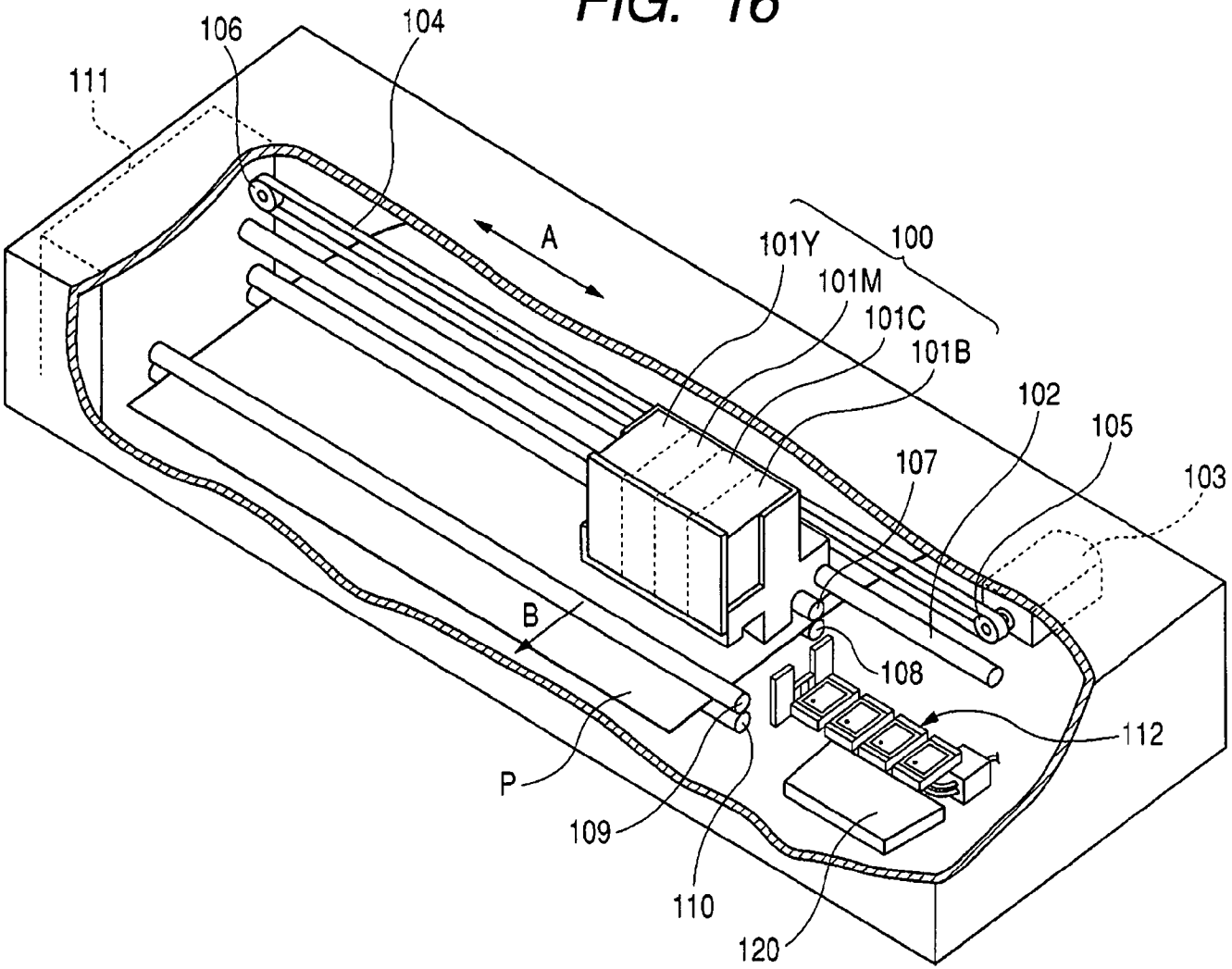
FIG. 16 is a frame format perspective view explaining the entire recording device.

FIG. 16 is a broken perspective view explaining the entire recording device mounted with the recording head. A medium to be recorded P fed to the device is conveyed to a recordable region of the recording head unit 100 by feeding rollers 109, 110 serving as medium conveying means. The recording head unit 100 is movably guided by two guide shafts 107, 102 along an extending direction (main scanning direction), and scans the recording region in a reciprocating manner. The scanning direction of the recording head unit 100 is the main scanning direction, and the conveying direction of the medium to be recorded P is the sub-scanning direction. The recording head for discharging ink droplets of a plurality of colors, and an ink tank 101 for supplying ink to each recording head are arranged in the recording head unit 100. The inks of a plurality of colors in the ink jet recording device of this example are four colors of black (Bk), cyan (C), magenta (M), and yellow (Y). The position of each color is in random order.

A recovery system unit 112 is arranged at the lower part of the right end on the region where the recording head unit 100 is movable to perform recovery process on the discharge port of the recording head during the non-recording operation.

In this case, the ink tanks for each color ink (Bk, C, M, Y) of black, cyan, magenta and yellow are all independently changeable. The recording head unit 100 is mounted with the recording head group for discharging Bk ink droplets, C ink droplets, M ink droplets, and Y ink droplets, Bk ink tank 101B, C ink tank 101C, M ink tank 101M, and Y ink tank 101Y. Each ink tank is connected to the recording head group, and supplies ink to the nozzle flow path communicating with the discharge port of the recording head group. Other than such example, the ink tank for each color may be integrally configured at an arbitrary combination.

This application claims priority from Japanese Patent Application Nos. 2005-175897 filed on Jun. 16, 2005 and 2005-362597 filed on Dec. 16, 2005, which are hereby incorporated by reference herein.

What is claimed is:

1. A liquid discharge head, comprising:

a discharge port for discharging liquid;

a liquid chamber communicating with the discharge port;

a piezoelectric element including one electrode layer having a uniform thickness and independently arranged in correspondence with the liquid chamber, another electrode layer having a uniform thickness and a piezoelectric film having a uniform thickness and sandwiched between the one electrode layer and the other electrode layer, and including a piezoelectric drive portion at which the piezoelectric film deforms and displaces, arranged in correspondence with an entire width of the liquid chamber with respect to an arranging direction of the one electrode layer; and a vibration plate interposed between the piezoelectric element and the liquid chamber, a portion thereof corresponding to an outside of the liquid chamber being fixed, wherein a bending rigidity of both ends of the portion of the vibration plate corresponding to the liquid chamber in the arranging direction is greater than a bending rigidity of a region between both ends, wherein the Young's modulus of the portion corresponding to both ends of the vibration plate is greater than the Young's modulus of the region between both ends, and wherein the vibration plate is made by joining two materials, each having a different Young's modulus.

* * * * *